US006326570B1

(12) United States Patent
Fujii et al.

(10) Patent No.: US 6,326,570 B1
(45) Date of Patent: Dec. 4, 2001

(54) SWITCH

(75) Inventors: Takeshi Fujii, Tsuruga; Shoichi Ishihara, Kadoma; Teruhisa Matsushita; Yusaku Nishimura, both of Toyota, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/640,235

(22) Filed: Aug. 16, 2000

(30) Foreign Application Priority Data

Sep. 13, 1999 (JP) ..... 11-258485

(51) Int. Cl.[7] ..... H01H 13/12
(52) U.S. Cl. ..... 200/520; 200/531; 200/341
(58) Field of Search ..... 200/16 R–16 D, 200/520, 86.5, 530–536, 341

(56) References Cited

U.S. PATENT DOCUMENTS 3,437,775 * 4/1969 Riber ..... 200/167
4,384,176 * 5/1983 Chestnut ..... 200/1 A
5,008,505 4/1991 Takano et al. ..... 200/531
5,043,709 8/1991 Kim ..... 340/709
5,068,506 * 11/1991 Suzuki ..... 200/526
5,201,410 * 4/1993 Takano et al. ..... 200/531
5,715,932 2/1998 Motoyama et al. ..... 200/521
5,828,024 * 10/1998 Takano et al. ..... 200/531
5,836,442 * 11/1998 Hirano ..... 200/284
5,952,631 9/1999 Miyaki ..... 200/6 A

* cited by examiner

*Primary Examiner*—Michael Friedhofer
(74) *Attorney, Agent, or Firm*—Jordan and Hamburg LLP

(57) ABSTRACT

A pair of stationary contacts is held on the inner wall of a cylindrical case. The case is closed by a cover having a through-hole, and a bearing is fixed on the cover, such that an operation shaft extends through the bearing such as to be vertically displaceable with respect to the case. The operation shaft is biased upwards by a coil spring provided between its lower end and the bottom surface of the case. A contact piece having a plurality of movable contacts is inserted between the lower end of the operation shaft and the spring, such that it makes contact with the stationary contacts and separates therefrom along with the axial movements of the operation shaft.

11 Claims, 14 Drawing Sheets

SWITCH

BACKGROUND OF THE INVENTION

1. Technical Field of the Invention

The present invention relates to a switch used for controlling switching-on and-off of a stop lamp that is turned on and off in operable connection with a brake pedal in an automobile.

2. Description of Related Art

There are two types of stop lamp switch of an automobile: One is a large-current type, wherein a stop lamp circuit connected to a power source is directly opened and closed with a switch, and the other is a small-current type, wherein such stop lamp circuit is indirectly opened and closed by the control of a microprocessor in an electronic circuit through relays or the like. With the progress of overall electronic control of automobiles in recent years, the latter has found more applications.

One of the conventional switches will be described below with reference to FIGS. 11 to 14.

FIG. 11 is a cross sectional view of a conventional switch and FIG. 12 is an exploded perspective of the same. The switch 10 comprises a cylindrical case 1 made of insulating resin having an inner bottom surface 1A and an upper open end. A pair of stationary contacts 2 consisting of a conductive metal plate is embedded in the inner wall 1B of the case 1. The distal ends of this pair of stationary contacts 2 make connection parts 2A and protrude through apertures in the bottom of the case 1, these being connected to an electronic circuit of the automobile through a connector (not shown).

Reference numeral 3 denotes a contact piece that is made of a conductive thin metal plate having resiliency, and numeral 4 denotes an operation shaft that is accommodated within the case 1 such as to be displaceable in an upward and a downward directions. One end of the contact piece 3 is fixed to one side (right hand side in the drawing) of a support portion 4A at the lower end of the operation shaft 4 with a rivet 5, while the other end, which makes a pair of movable contacts 3A, is resiliently pressed against the stationary contacts 2. The contact piece 3 has two arms 3B connecting the movable contacts 3A with the base end of the contact piece, and these are slightly deformed when the movable contacts 3A are in contact with the stationary contacts 2. A coil spring 6 is inserted in a compressed state in a cavity 4B formed on the underside of the operation shaft 4 and pressed against the inner bottom surface 1A of the case 1 so that it gives the operation shaft 4 an upward biasing force.

The upper open end of the case 1 is covered by a cover 7, which has a through-hole 7A in the center thereof. A cylindrical bearing 8 having threads on the outer periphery thereof is fixed on the through-hole 7A, so that the operation shaft 4 extends through the through-hole 7A of the cover 7 and the hole 8A bored in the bearing 8.

The switch 10 constructed as described above is mounted to an automobile and operates as described below.

FIG. 13 is a side view showing a state wherein the switch 10 is mounted on an automobile. Reference numeral 11 denotes a brake pedal, which is integrally formed with an angle 11A. The upper end of the angle 11A is supported around a support 11B such as to be rockable in relation to the automobile body. The switch 10 is mounted to the automobile body with nuts 12 which engage the threads on the bearing 8 in a state wherein the operation shaft 4 is pressed by the angle 11A.

As previously mentioned, a connector 13 is attached to the switch 10, so that one of the pair of stationary contacts 2 is directly connected to an electronic circuit 15 of the automobile, while the other stationary contact 2 is connected to the electronic circuit 15 through a power source 14. The electronic circuit 15 comprises microprocessors for controlling a stop lamp circuit, anti-lock brake system, traction control device, and others.

While the operation shaft 4 of the switch is pressed by the angle 11A, the movable contacts 3A of the contact piece 3 are resiliently pressed against the inner wall 1B of the case 1 at a point that is away from the stationary contacts 2, as shown in FIG. 14A. When the brake pedal 11 is depressed, as indicated by broken lines in FIG. 13, the angle 11A rocks around the support 11B as the fulcrum. When the angle 11A departs from the operation shaft 4 of the switch 10, the operation shaft 4 returns to the state shown in FIG. 11 by the force of the coil spring 6, whereupon the movable contacts 3A of the contact piece 3 slide against the inner wall 1B of the case 1 as being resiliently pressed thereto, and contact the pair of stationary contacts 2 as shown in FIG. 14B. The two stationary contacts 2 are thus connected to each other through the contact piece 3, thereby turning on the stop lamp.

In such switch as described above, because the movable contacts 3A of the contact piece 3 make point contact with the stationary contacts 2 and they slide against the stationary contacts 2 and the inner wall 1B of the case 1 always at the same point, when foreign substances exist between the contacting parts, they cannot establish reliable contact with each other. Particularly, it is often the case that foreign substances, such as galls of the insulating resin of the case 1 or carbides due to the arcs generated when the contact piece 3 contacts with and separates from the stationary contacts 2, are deposited on the stationary contacts 2.

Moreover, the contact piece 3 is held on one side of the support part 4A at the lower end of the operation shaft 4, and the movable contacts 3A of the contact piece 3 are pressed against the stationary contacts 2 through the arms 3B that are slightly deformed. A certain load is thus exerted to the operation shaft 4 on one side, whereby the operation shaft 4 is accommodated in a slightly tilted manner within the case 1 and the bearing 8, within a range determined by the gaps present between the operation shaft 4 and the hole 8A of the bearing 8. Consequently, when mounted on the automobile, as the brake pedal 11 is depressed and the angle 11A departs from the operation shaft 4, whereby the operation shaft 4 is released from the pressing force from the angle 11A and restores to its initial position by means of the coil spring 6, the switch 10 may sometimes produce noises, as the tilted operation shaft 4 collides against the case 1 or the bearing 8.

SUMMARY OF THE INVENTION

In view of the foregoing, an object of the present invention is to provide a switch for turning on and off the brake lamp of an automobile, whereby stable contact at the contacting portions can be achieved and noises in operation can be eliminated.

To accomplish the above object, a switch according to the present invention comprises:

- a cylindrical case made of insulating resin having an upper open end;
- a pair of opposite spaced stationary contacts arranged on an inner wall of the case, each of said pair of stationary contacts having a contact part that extends vertically within the case in a position spaced away from the inner wall of the case, with a lower end thereof being bent outwards;

an operation shaft that is supported within the case such as to be displaceable with respect to the case in an upward and a downward directions;

a coil spring provided within the case for biasing the operation shaft upwards;

a cover for closing the upper open end of the cylindrical case, said cover having a central through-hole through which the operation shaft passes;

a bearing connected to the upper open end of the cylindrical case for uprightly supporting the operation shaft; and a contact piece inserted between a bottom end of the operation shaft and the coil spring, said contact piece comprising a middle part at which it is connected to the bottom end of the operation shaft, a pair of arms that extend obliquely downward from opposite edges of said middle part in an outwardly spreading manner, and a pair of movable contacts at leading ends of said pair of arms.

According to the present invention, a switch that establishes stable contact between contacting parts without producing any noise can be obtained.

Other and further objects, features and advantages of the invention will appear more fully from the following description.

DESCRIPTION OF PREFERRED EMBODIMENTS

Figure 1:
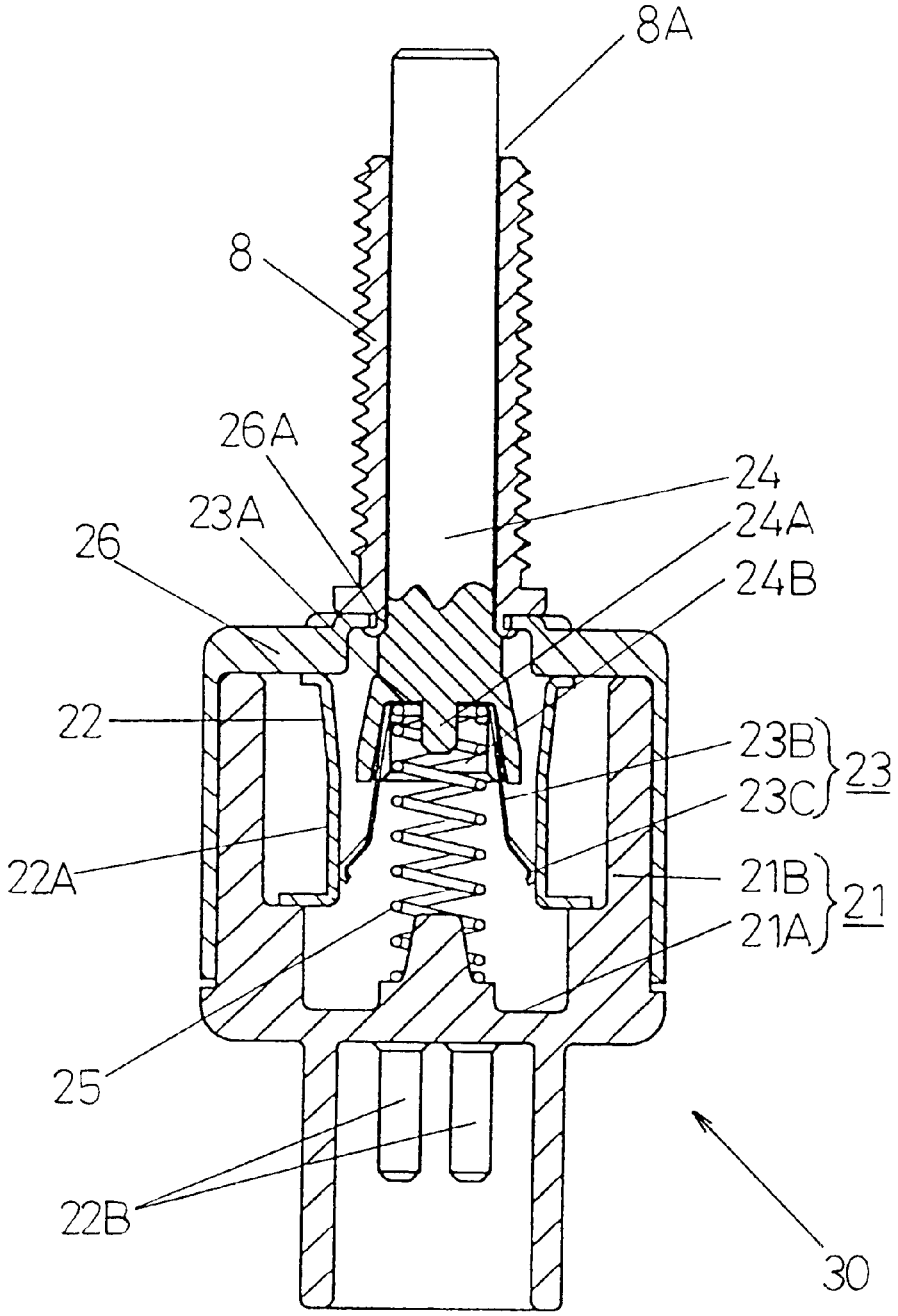
FIG. 1 is a cross-sectional view of a switch in accordance with a first embodiment of the present invention.

Preferred embodiments of the present invention will be hereinafter described with reference to FIGS. 1 through 10. Elements that are identical with or similar to those that have been described with regard to the prior art are given the same reference numerals, and they will no longer be described in detail.

(First Embodiment)

Figure 2:
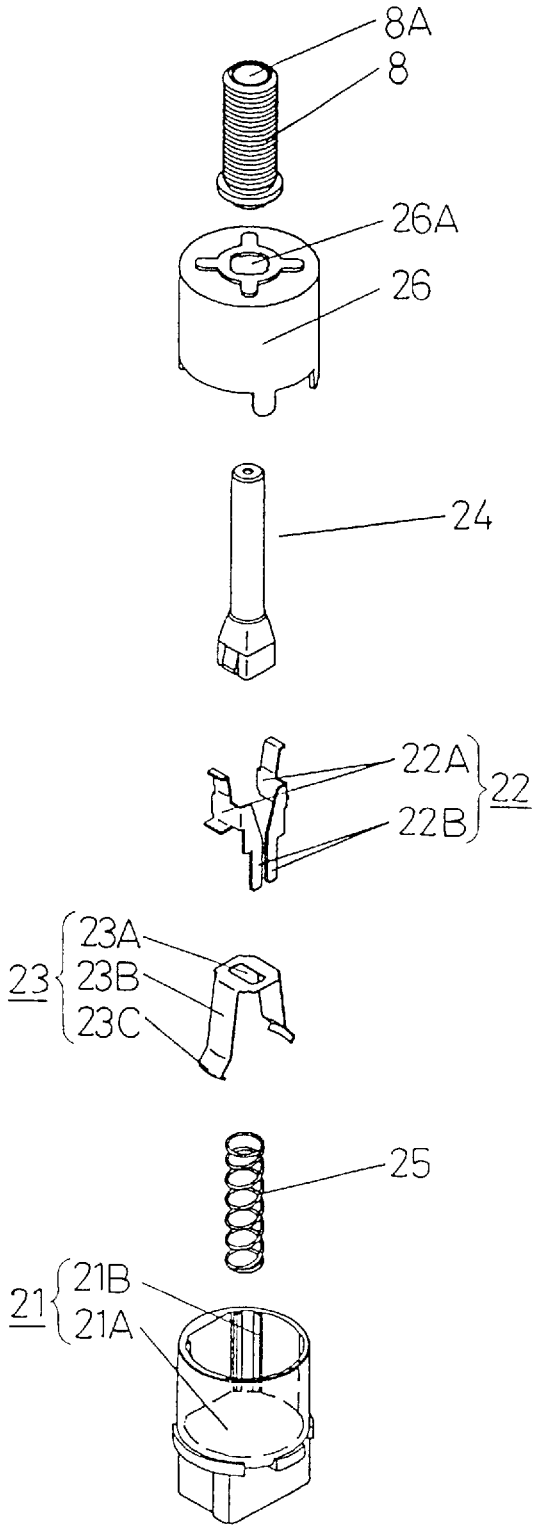
FIG. 2 is an exploded perspective view of same.

FIG. 1 is a cross-sectional view of a switch according to a first embodiment of the present invention, and FIG. 2 is an exploded perspective of the same. The switch 30 comprises a cylindrical case 21 made of insulating resin having an inner bottom surface 21A and an upper open end. A pair of spaced opposite stationary contacts 22 consisting of a conductive metal plate is arranged in the case 21. Each of the stationary contacts 22 comprises a contact part 22A that has a U-shaped cross section so that the middle portion thereof is spaced away from the inner wall 21B of the case 21, and a connection part 22B at the distal end thereof, which protrudes through an aperture in the bottom of the case 21, this being connected to an electronic circuit of the automobile through a connector (not shown).

Reference numeral 23 denotes a contact piece made of a conductive thin metal plate having resiliency, and reference numeral 24 denotes an operation shaft that is accommodated within the case 21 such as to be movable in an upward and a downward directions. The contact piece 23 has a hole 23A in the center thereof, and further has arms 23B extending therefrom on both sides, and movable contacts 23C at respective leading ends of the arms 23B. When the operation shaft 24 is accommodated within the case 21, a projection 24A formed on the lower end of the operation shaft 24 fits in the hole 23A of the first contact piece 23, while the pair of movable contacts 23C is in resilient contact with the pair of contact parts 22A of the stationary contacts 22, respectively, in a state wherein the arms 23B of the contact piece 23 are slightly deformed.

A coil spring 25 is inserted between a cavity 24B on the bottom end of the operation shaft 24 and the inner bottom surface 21A of the case 21 in a slightly deformed fashion, whereby the operation shaft 24 is biased upwards. A cover 26 for closing the upper open end of the case 21 has a through hole 26A on the top surface in the middle thereof, on which a cylindrical bearing 8 having threads on its outer peripheral surface and a hole 8A in its center is fixedly attached. Thus the operation shaft 24 extends upright through the bearing 8.

Figure 3:
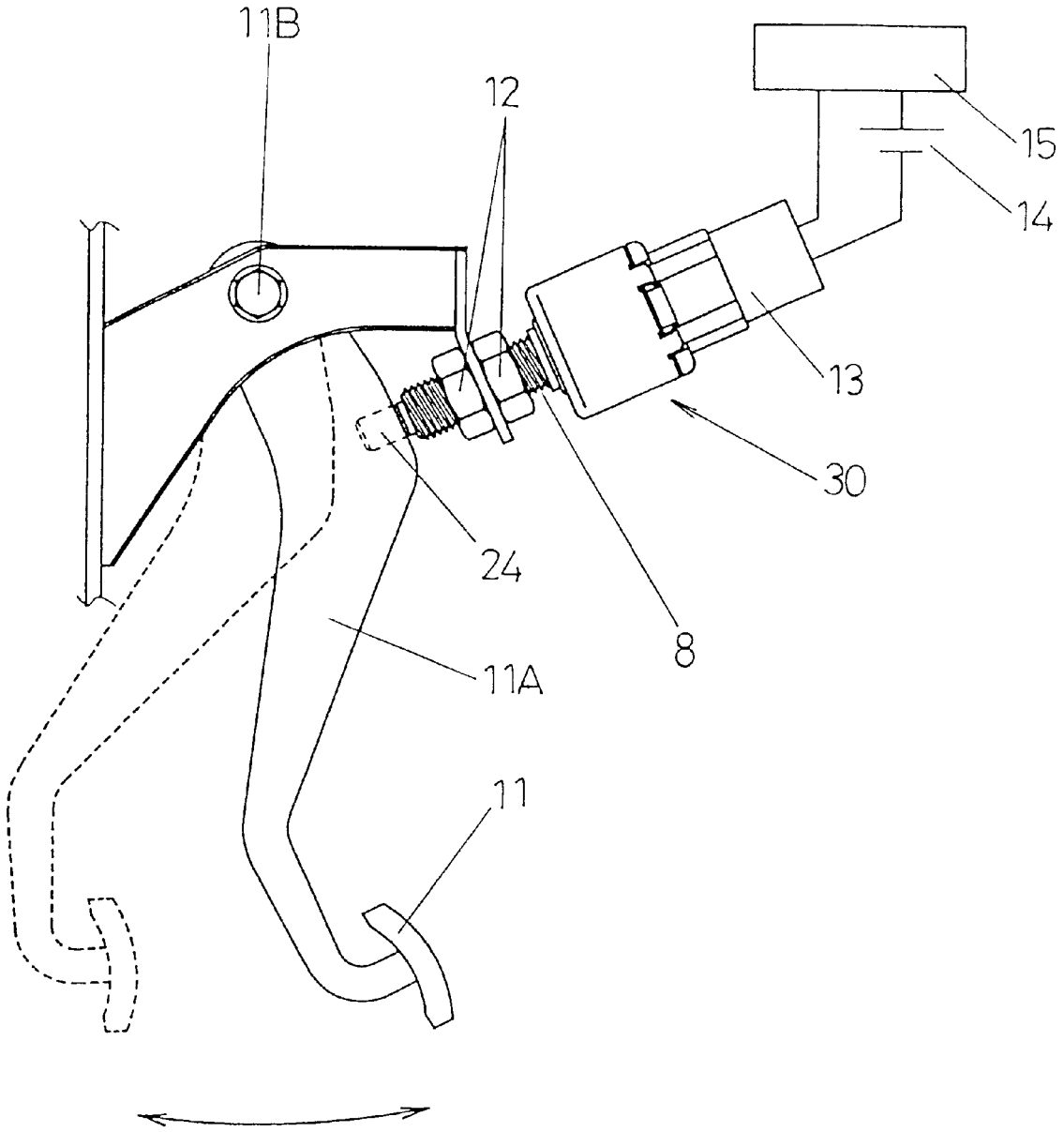
FIG. 3 is a side view of same when mounted to an automobile.

The switch 30 constructed as described above is mounted on an automobile body, as shown in FIG. 3, in a similar manner as the prior art example that has been described previously. The outer periphery of the bearing 8 is attached to the automobile body with nuts 12, in a state wherein the operation shaft 24 is pressed by the angle 11A that is integral with the brake pedal 11. One of the stationary contacts 22 is directly connected to the electronic circuit 15 of the automobile comprising a microprocessor through the connector 13, while the other one of the stationary contacts 22 is connected to the electronic circuit 15 via a power source 14.

Figure 4:
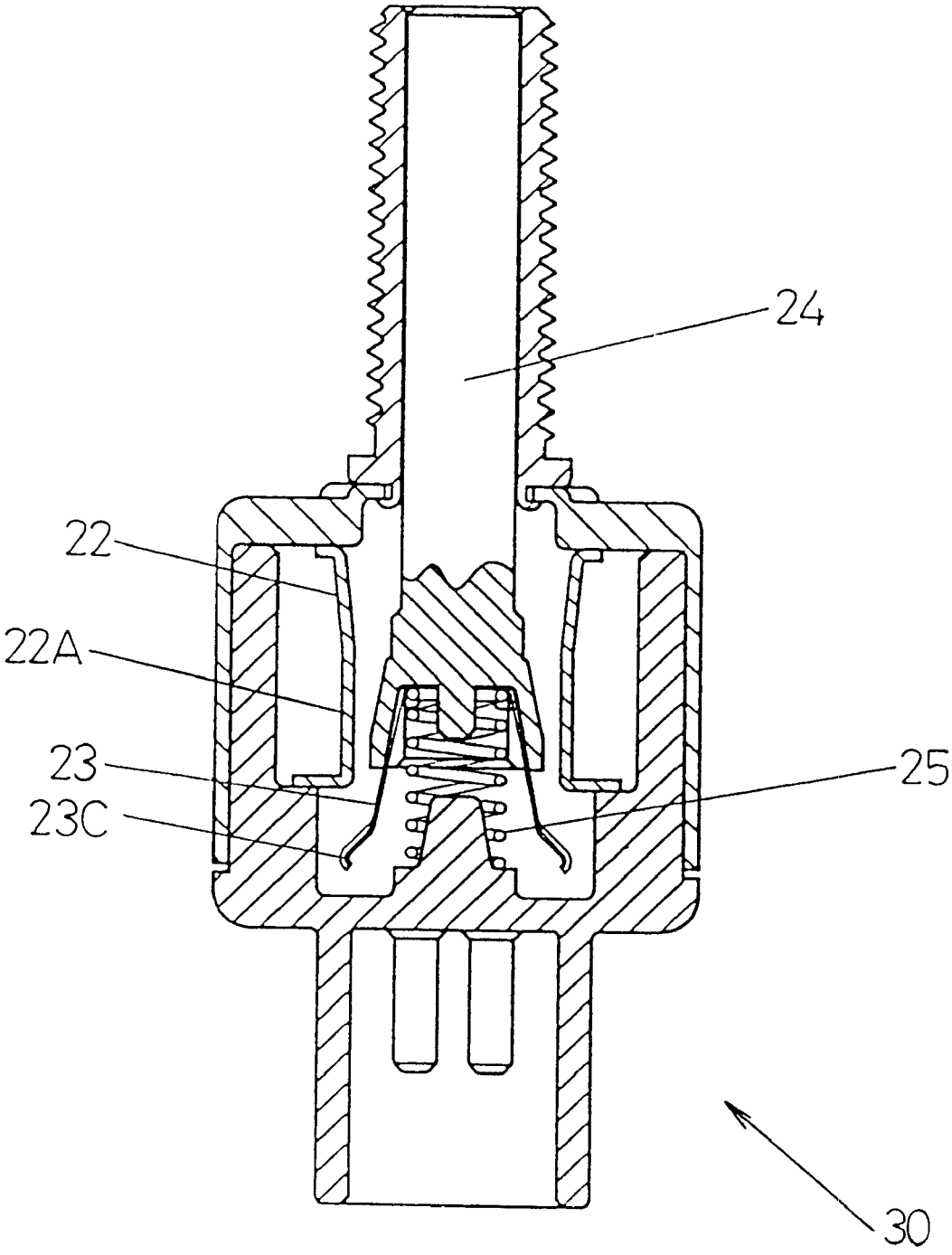
FIG. 4 is a cross-sectional view of same in a pressed state.
Figure 5A:
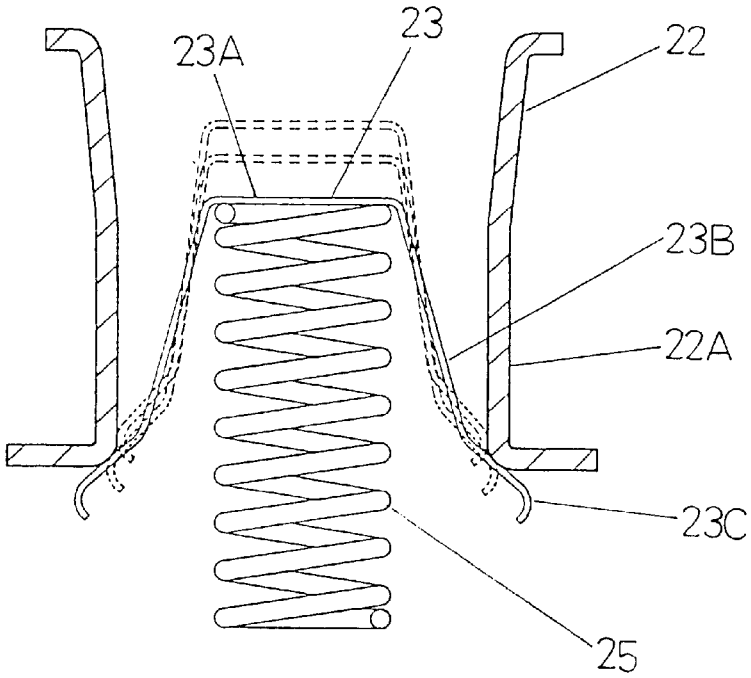
FIGS. 5A and 5B are cross-sectional views illustrating contacting parts in the first embodiment.
Figure 5B:
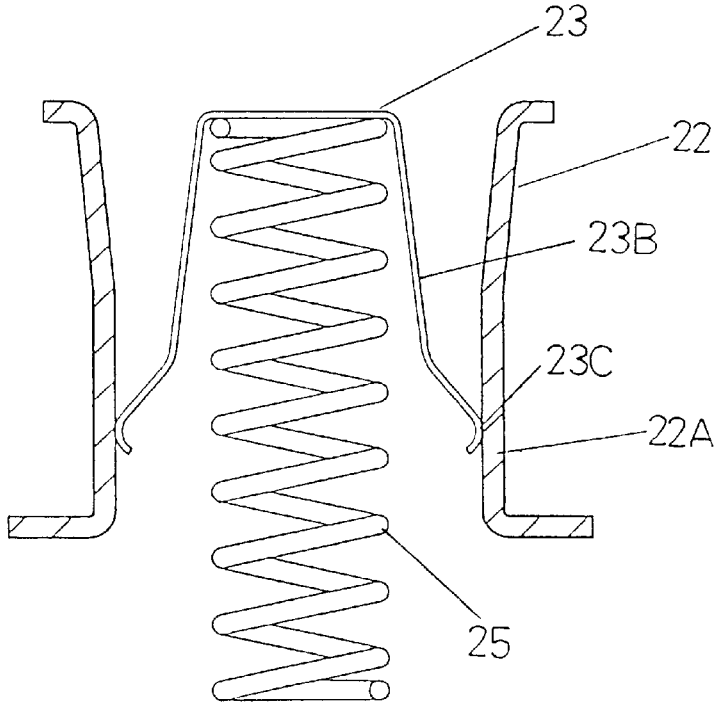

While the operation shaft 24 of the switch 30 is pressed by the angle 11A, the movable contacts 23C of the contact piece 23 are separated from the contact parts 22A of the stationary contacts 22, as shown in FIG. 4. When the brake pedal 11 is depressed, as indicated by broken lines in FIG. 3, the angle 11A integrally formed with the brake pedal 11 rocks around the support 11B as the fulcrum. When the angle 11A departs from the operation shaft 24 of the switch 30, the operation shaft 24 restores to its initial state shown in FIG. 1 by the force of the coil spring 25. At this time, the arms 23B of the contact piece 23 first make contact with bent portions at the lower ends of the contact parts 22A of the stationary contacts 22 as shown in FIG. 5A. Thereafter, the movable contacts 23C at the leading ends of the arms 23B slide against the contact parts 22A of the stationary contacts 22 in resilient contact therewith, as indicated by broken lines in FIG. 5A, and the contact piece 23 eventually restores to its initial position as shown in FIG. 5B, whereby the stationary contacts 22 are electrically connected to each other, so that the stop lamp is turned on.

According to this embodiment, as described above, contact between the contact piece 23 and the stationary contacts 22 is achieved such that the arms 23B of the contact piece 23 contact the stationary contacts 22 in the beginning, and then the movable contacts 23C make contact with the contact parts 22A of the stationary contacts 22. In other words, the contact piece 23, when making contact with the stationary contacts 22, changes the point of contact gradually as it restores to its initial position, and therefore, foreign substances such as galls of the insulating resin of the case 21 or carbides produced by the arcs at the time of contacting and separating can hardly deposit at the contact point. The contact piece 23 can thus establish stable contact with the stationary contacts 22.

Moreover, when the pair of movable contacts 23C at opposite leading ends of the contact piece 23 is in resilient contact with the pair of stationary contacts 22 that are arranged opposite each other on the inner wall 21B of the case 21, the operation shaft 24 receives resilient load from the contact piece 23 uniformly from both sides, thus causing the operation shaft 24 to stand upright within the case 21 and the bearing 8. Therefore, even though the switch 30 is mounted on the automobile body in an inclined manner and the operation shaft 24 is pressed by the angle 11A, it produces no objectionable noise.

(Second Embodiment)

Figure 6:
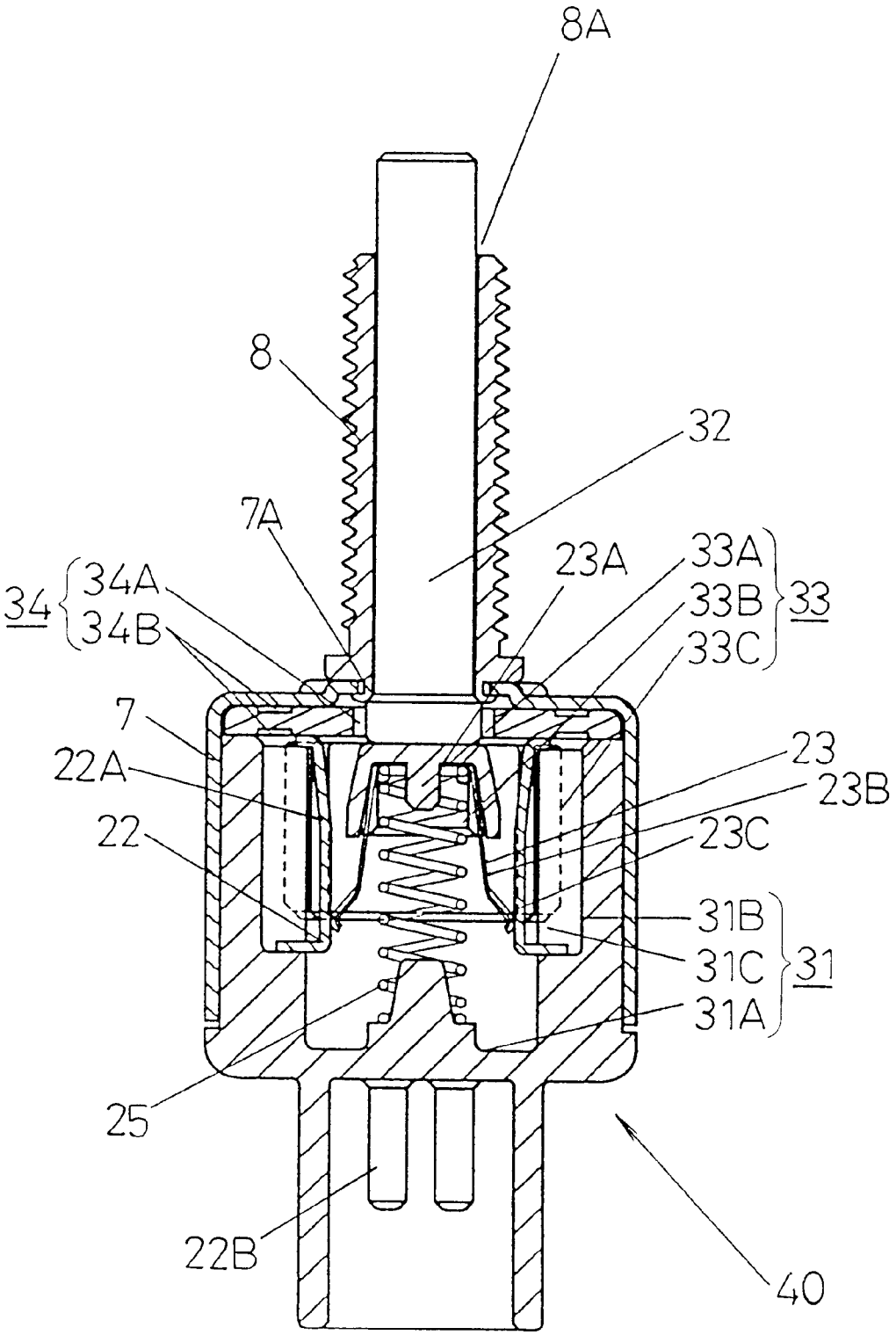
FIG. 6 is a cross-sectional view of a switch in accordance with a second embodiment of the present invention.
Figure 7:
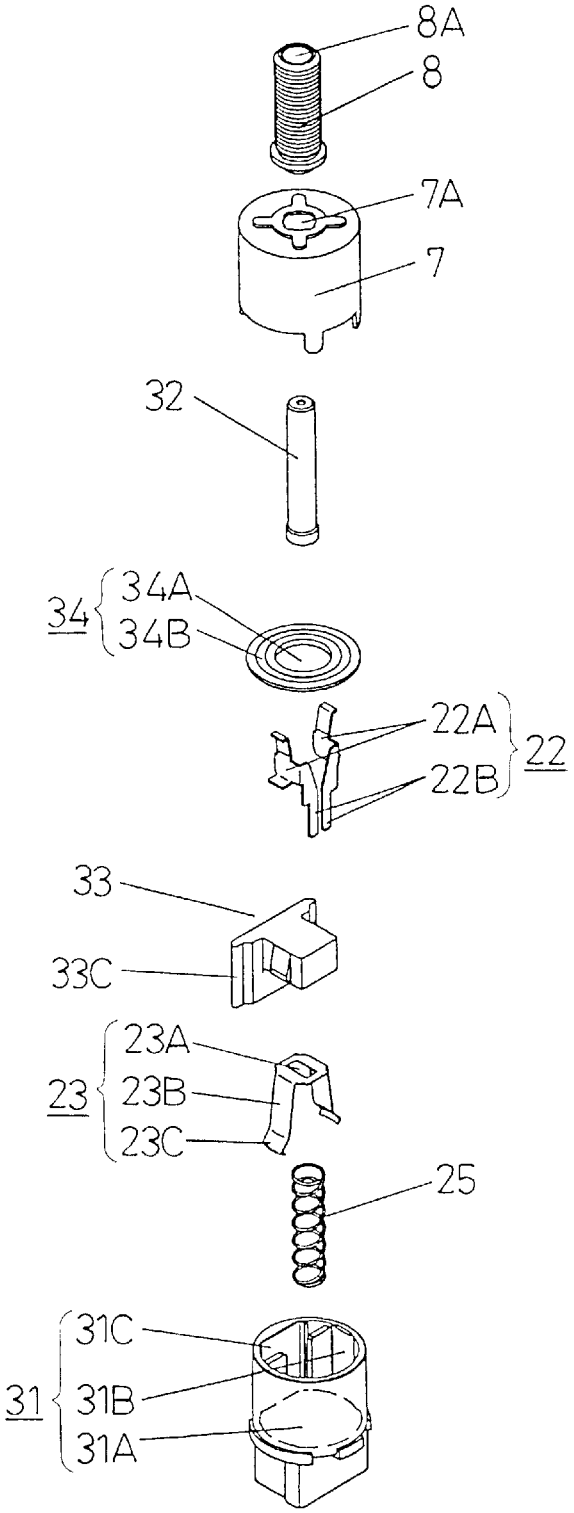
FIG. 7 is an exploded perspective view of same.

FIG. 6 is a cross-sectional view of a switch according to a second embodiment of the present invention, and FIG. 7 is an exploded perspective of the same. Similarly to the first embodiment described above, the switch 40 comprises a cylindrical case 31 made of insulating resin having an inner bottom surface 31A and an upper open end. A pair of stationary contacts 22 is disposed in the case 31 such that their spaced opposite contact parts 22A are arranged facing the inner wall 31B of the case 31. The upper open end of the case 31 is closed by a cover 7.

A cylindrical bearing 8 having threads on its periphery is fixed at its bottom end to the edge of a through-hole 7A formed in the center on the top face of the cover 7. The operation shaft 32 of this embodiment extends through the hole 8A bored in the bearing 8 similarly to the first embodiment. One characteristic feature of this embodiment is that a drive member 33 is accommodated within the case 31 such that its upper surface abuts the bottom surface of the operation shaft 32.

A coil spring 25 is mounted between a cavity 33B formed at the lower end of the drive member 33 and the inner bottom wall 31A of the case 31 in a slightly compressed manner, and the contact piece 23 is inserted between this coil spring 25 and the lower end of the drive member 33. A projection 33A is formed protruding on the lower end of the drive member 33, which fits in the center hole 23A of the contact piece 23. Thus, the drive member 33 and the operation shaft 32 are biased upwards by the coil spring 25 via the contact piece 23.

The drive member 33 has protruded parts 33C on its lateral edges, that are inserted into a guide groove 31C formed in the inner wall 31B of the case 31. Furthermore, the switch 40 has a spacer 34, made of relatively soft insulating resin, inserted between the upper edge of the case 31 and the cover 7. The spacer 34 has a center through-hole 34A through which the operation shaft 32 can pass, and annular grooves 34B formed on the top and bottom surfaces thereof, respectively.

The switch 40 is mounted on the automobile body in a state wherein the operation shaft 32 is pressed by the angle 11A, and when the brake pedal is depressed, the operation shaft 32 restores to its initial position shown in FIG. 6 by the force of the coil spring 25. In returning to its initial position, the operation shaft 32 is pressed upwards by the drive member 33 that abuts the lower end of the operation shaft 32, because the coil spring 25 is inserted between the lower end of the drive member 33 and the inner bottom surface 31A of the case 31. As the contact piece 23 is brought upwards, its arms 23B first contact the bent portions of the pair of contact parts 22A of the stationary contacts 22, and then the movable contacts 23C of the contact piece 23 make contact with the contact parts 22A of the stationary contacts 22, whereby the two stationary contacts 22 are electrically connected with each other and the stop lamp is turned on.

According to this embodiment, as described above, a drive member 33 is provided independently of the operation shaft 32 for holding the contact piece 23. Therefore, even if the operation shaft 32 is pressed in a tilted or twisted manner, such unbalanced load does not act directly on the contact piece 23, whereby deformation or breakage of the contact piece 23 can be prevented, and stable contact between the contact piece 23 and the stationary contacts 22 can be maintained.

Furthermore, thanks to the spacer 34 provided between the open edge of the case 31 and the cover 7, the sealing performance of the switch 40 is improved. The annular grooves 34B formed in the upper and lower surfaces of the spacer 34 inhibit any liquid from flowing into the contacting parts, and they contribute effectively to the water-or oil-proof performance of the switch 40.

Figure 8A:
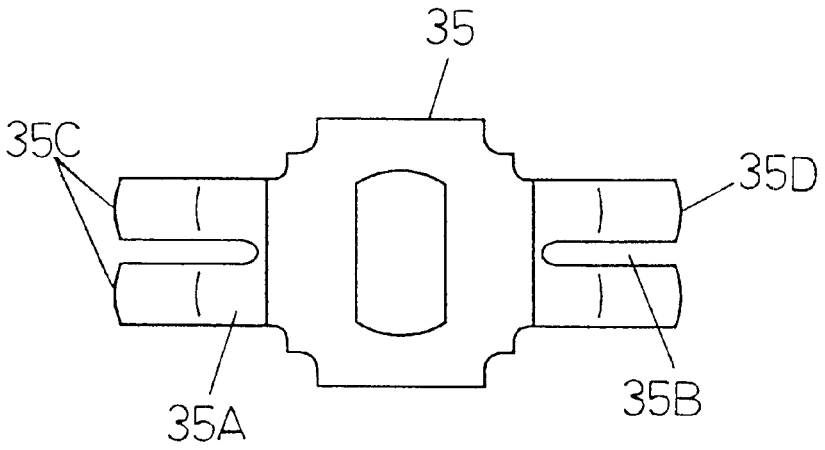
FIG. 8A is a plan view and FIG. 8B is a perspective view showing a modified example of a contact piece in the same embodiment.
Figure 8B:
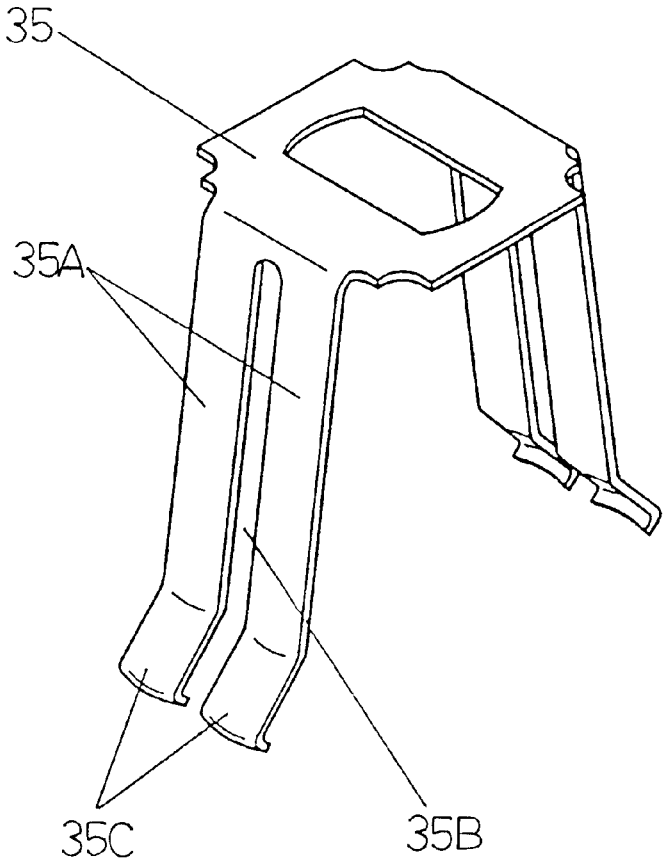

FIGS. 8A and 8B illustrate a modification of the contact piece denoted at numeral 35. The contact piece 35 can be configured to have slits 35B in the arms 35A opened in their lengthwise direction, so that each of the arms 35A can have a plurality of movable contacts 35C, two each in this specific example, at the distal ends thereof, whereby they can assure more stable contact with the stationary contacts.

The movable contacts 35C of the contact piece 35 are formed with curved ends as shown in FIG. 8B, and shaped convexly when observed from the top as shown in FIG. 8A. Thereby, the movable contacts 35C can make contact with the contact parts 22A of the stationary contacts 22 without touching the stationary contacts 22 with burrs on cut edge of the contact piece 35 that may be produced during fabrication of the contact piece. Galling or scratching of contacting parts is thus prevented, and stable contact can be achieved.

(Third Embodiment)

Figure 9:
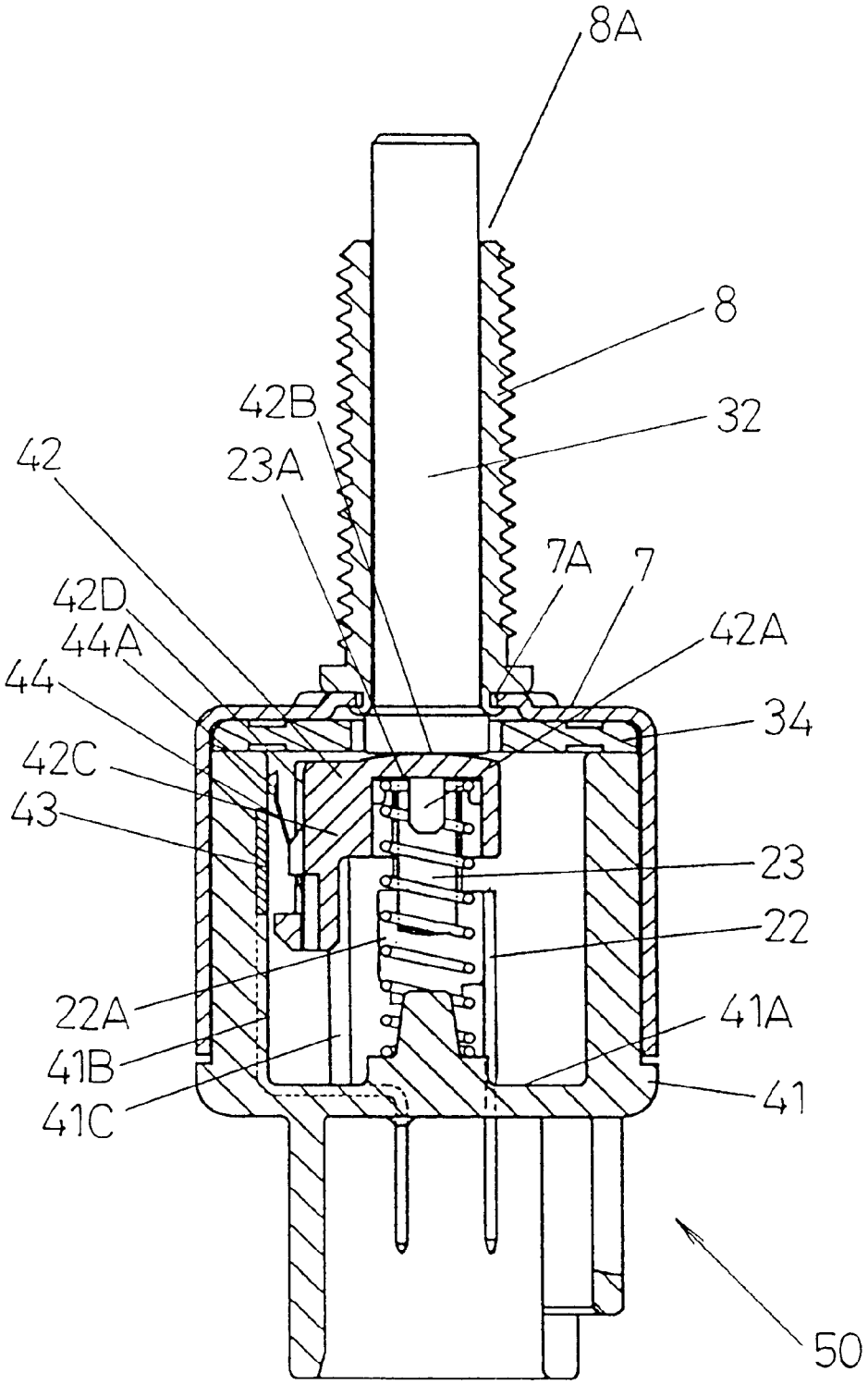
FIG. 9 is a cross-sectional view of a switch in accordance with a third embodiment of the present invention.
Figure 10:
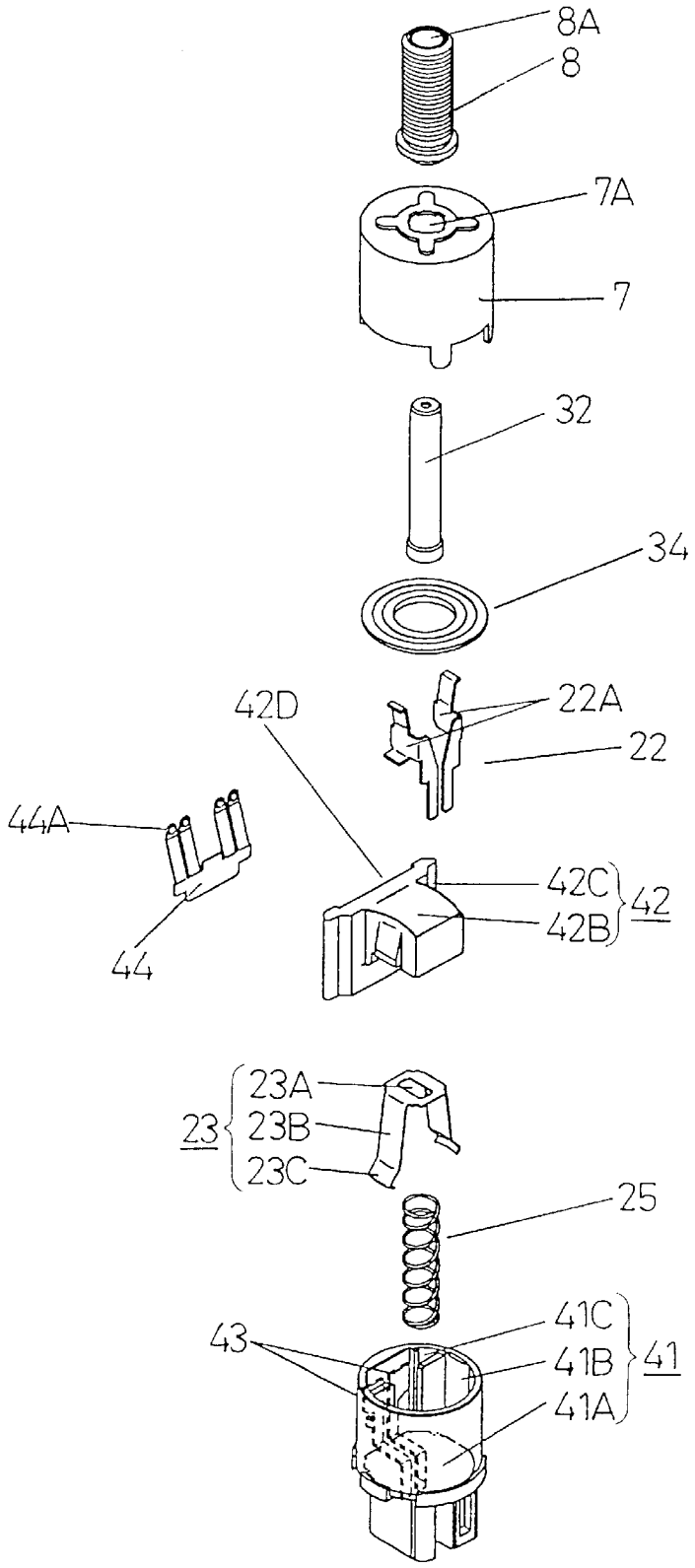
FIG. 10 is an exploded perspective view of same.
Figure 11:
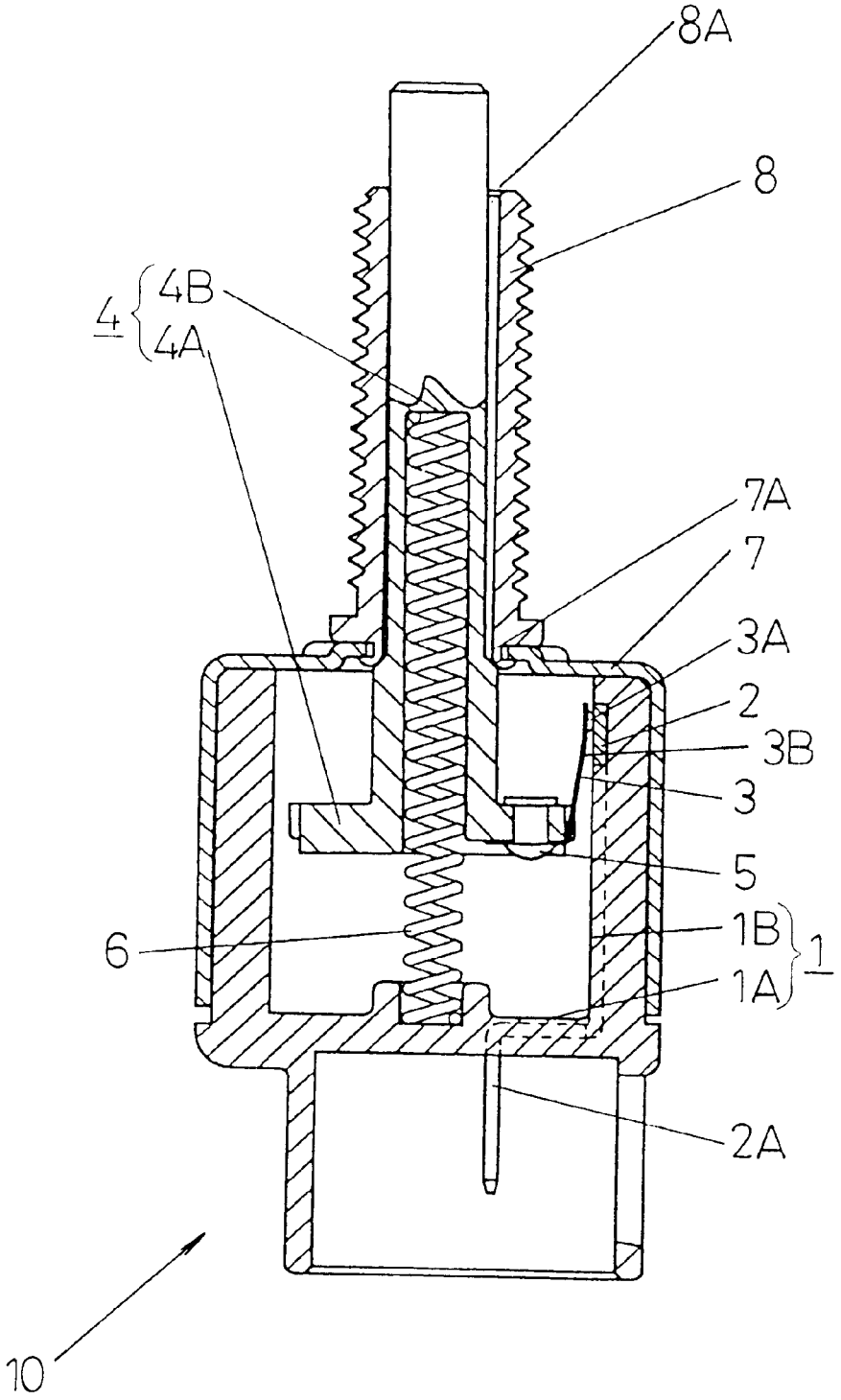
Fig. 11 Prior Art
FIG. 11 is a cross-sectional view of a conventional switch.
Figure 12:
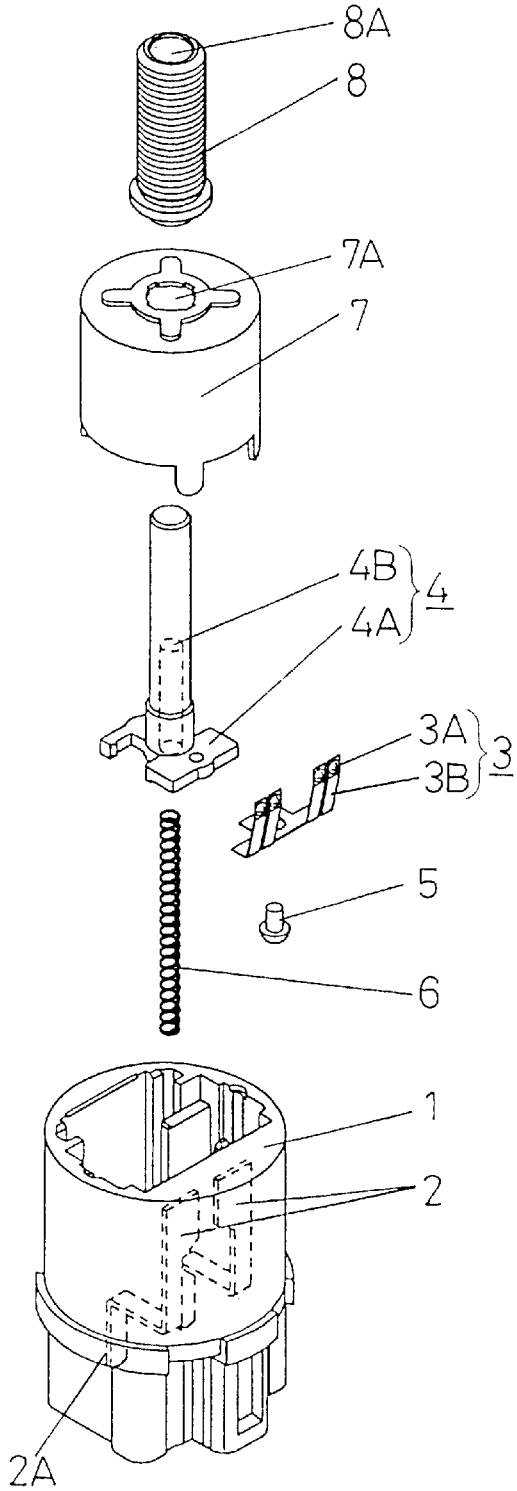
Fig. 12 Prior Art
FIG. 12 is an exploded perspective view of same.
Figure 13:
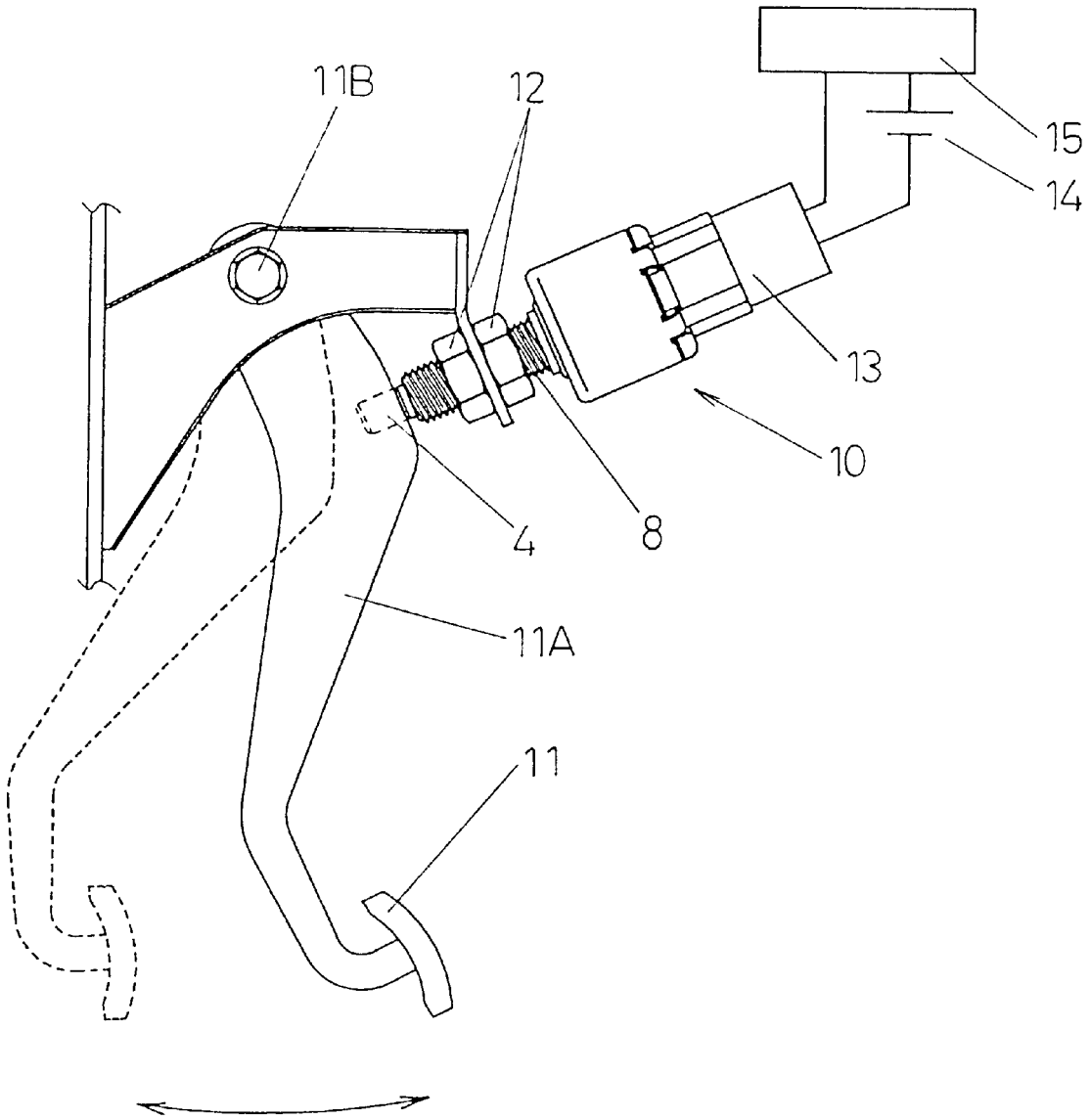
Fig. 13 Prior Art
FIG. 13 is a side view of same when mounted to an automobile.
Figure 14A:
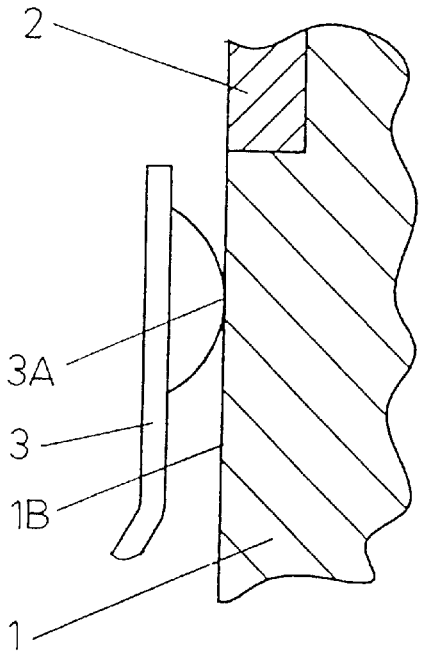
Prior Art Fig. 14A
FIGS. 14A and 14B are cross-sectional views illustrating contacting parts of the conventional switch.
Figure 14B:
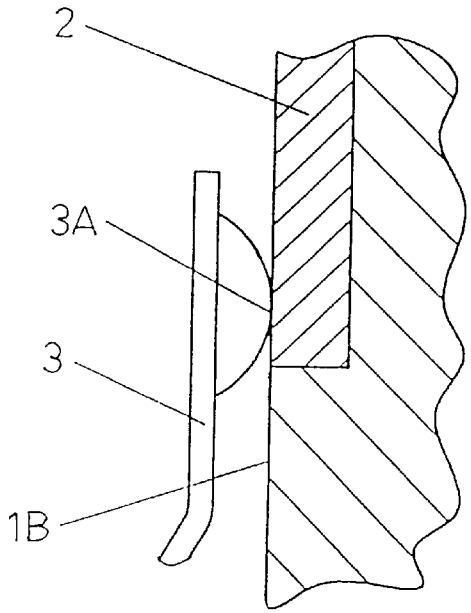

FIG. 9 is a cross-sectional view of a switch according to a third embodiment of the present invention, and FIG. 10 is an exploded perspective of the same. Similarly to the first and second embodiments described above, the switch 50 comprises a cylindrical case 41 made of insulating resin having an inner bottom surface 41A and an upper open end. A pair of stationary contacts 22 is disposed in the case 41 such that their contact parts 22A are arranged opposite each other on the inner wall 41B of the case 41. The upper open end of the case 41 is closed by a cover 7. A cylindrical bearing 8 having threads on its periphery is fixed at its bottom end to the edge of a through-hole 7A formed in the center on the top face of the cover 7. The operation shaft 32 extends through the hole 8A bored in the bearing 8.

The bottom end of the operation shaft 32 abuts a drive member 42, that is accommodated within the case 41 such as to be displaceable in an upward and a downward directions. The drive member 42 has a projection 42A protruding from its bottom end, which fits into the center hole 23A of the contact piece 23. A spacer 34 is inserted between the open edge of the case 41 and the cover 7. One characteristic feature of this embodiment is that the upper surface of the drive member 42, which makes its abutting portion 42B that is in contact with the lower end of the operation shaft 32, is formed in a curved manner such as an arched surface.

Another feature of this embodiment is that, in the inner wall 41B of the case 41 on the side where a guide groove 41C is formed in which projected parts 42C of the drive member 42 on lateral edges thereof are inserted, a pair of second stationary contacts 43 is embedded. Corresponding to this pair of second stationary contacts 43, a second contact piece 44 is held on one side 42D of the drive member 42. The second contact piece 44 includes movable contacts 44A at its leading end, which make resilient contact with the second stationary contacts 43, thereby constituting another switch.

Similarly to the second embodiment described above, the switch is mounted on the automobile body in a state wherein the operation shaft 32 of the switch 50 is pressed by the angle 11A, and when the brake pedal is depressed, the arms 23B and the movable contacts 23C of the contact piece 23 held below the drive member 42 successively make contact with the contact parts 22A of the stationary contacts 22, whereupon the stop lamp is turned on.

In this embodiment, the bottom end of the operation shaft 32, when pushed upwards by the coil spring 25, is pressed by the curved abutting part 42B on the top surface of the drive member 42. At this time, the second contact piece 44 held in the side face 42D of the drive member 42 also makes contact with the second stationary contacts 43, whereby switching of another function can simultaneously be accomplished. That is, automatic control of the automobile by a microprocessor includes some functions that are desired to be cancelled when the brake is being used. For example, there is an automatic drive circuit that controls the running speed of the automobile, and such function needs to be turned off during the braking. The second contact piece 44 and the second stationary contacts 43 accomplish the switching of such function simultaneously with the switching of the stop lamp.

According to this embodiment, as described above, in addition to the switching of the stop lamp by the contact piece 23 and the stationary contacts 22, the switch 50 has another pair of contact piece and stationary contacts, thereby accomplishing simultaneous switching of another function.

Moreover, since the bottom end of the operation shaft 32 abuts the arch-like abutting part 42B on the top surface of the drive member 42, it only makes point or line contact with the top surface of the drive member 42. Accordingly, the unbalanced load that may be exerted to the operation shaft 32 can hardly act on the drive member 42. Therefore, deformation or breakage of the first contact piece 23 can be prevented more reliably.

In each of the embodiments described above, the movable contacts of the contact piece 23 and the second contact piece 44 have been described as being integrally formed with the contact piece itself. However, the movable contacts can of course be constructed by fixing a separate, rivet-like contact to the contact piece 23 or 44 in accordance with the voltage or current applied in the switch. Further, although the contact parts 22A of the stationary contacts 22 are formed to have a U-shaped cross section in the specific examples given above, they may be configured to have an L-shaped cross section, with their lower ends being bent at right angles, while their upper ends being straight. In short, the stationary contacts 22 can be of any shape as long as they extend vertically within the case, with their contact parts 22A protruding inwards from the inner wall of the case, and with the lower ends of the contact parts 22A being bent outwards.

Although the present invention has been fully described in connection with the preferred embodiment thereof, it is to be noted that various changes and modifications apparent to those skilled in the art are to be understood as included within the scope of the present invention as defined by the appended claims unless they depart therefrom.

What is claimed is:

1. A switch comprising:

a cylindrical case made of insulating resin having an upper open end;

a pair of opposite spaced stationary contacts arranged on an inner wall of the case, each of said pair of stationary contacts having a contact part that extends vertically within the case in a position spaced away from the inner wall of the case, with a lower end thereof being bent outwards;

an operation shaft that is supported within the case such as to be displaceable with respect to the case in an upward and a downward directions;

a coil spring provided within the case for biasing the operation shaft upwards;

a cover for closing the upper open end of the cylindrical case, said cover having a central through-hole through which the operation shaft passes;

a bearing connected to the upper open end of the cylindrical case for uprightly supporting the operation shaft; and a contact piece inserted between a bottom end of the operation shaft and the coil spring, said contact piece comprising a middle part at which said contact piece is connected to the bottom end of the operation shaft, a pair of arms that extend obliquely downward from opposite edges of said middle part in an outwardly spreading manner, and a pair of movable contacts at leading ends of said pair of arms.

2. The switch according to claim 1, wherein each of said pair of arms of the contact piece is formed with a slit in a lengthwise direction, so that each of said pair of arms has a plurality of movable contacts at a leading end.

3. The switch according to claim 1, wherein the movable contacts of the contact piece are formed to have a convexly curved outline when viewed from above.

4. The switch according to claim 1, wherein a lower end of each of the arms of the contact piece is bent inwards, an outside surface of said bent portion making the movable contacts of the contact piece.

5. A switch comprising:

a cylindrical case made of insulating resin having an upper open end;

a pair of opposite spaced stationary contacts arranged on an inner wall of the case, each of said pair of stationary contacts having a contact part that extends vertically within the case in a position spaced away from the inner wall of the case, with a lower end thereof being bent outwards;

a drive member that is held within the case such as to be displaceable in an upward and a downward directions;

a coil spring provided within the case for biasing the drive member upwards;

an operation shaft held upon the drive member and supported movable in an upward and a downward directions;

a cover for closing the upper open end of the cylindrical case, said cover having a central through-hole through which the operation shaft passes;

a bearing connected to the upper open end of the cylindrical case for uprightly supporting the operation shaft; and a contact piece inserted between the drive member and the coil spring, said contact piece comprising a middle part at which said contact piece is connected to a bottom end of the drive member, a pair of arms that extend obliquely downward from opposite edges of said middle part in an outwardly spreading manner, and a pair of movable contacts at leading ends of said pair of arms.

6. The switch according to claim 5, wherein a top surface of said drive member that abuts a bottom end of the operation shaft is formed in a convexly curved shape.

7. The switch according to claim 5, wherein a pair of opposite spaced second stationary contacts is arranged in the inner wall of the case, while a second contact piece having movable contacts at a leading end thereof is held on one side of the drive member, so as to constitute an additional switch.

8. The switch according to claim 5, wherein a spacer made of an insulating resin having a central through-hole and an annular groove on at least one of a top surface and a bottom surface thereof is inserted between the upper open end of the case and the cover.

9. The switch according to claim 5, wherein each of said pair of arms of the contact piece is formed with a slit in a lengthwise direction, so that each of said pair of arms has a plurality of movable contacts at a leading end.

10. The switch according to claim 5, wherein the movable contacts of the contact piece are formed to have a convexly curved outline when viewed from above.

11. The switch according to claim 5, wherein a lower end of each of the arms of the contact piece is bent inwards, an outside surface of said bent portion making the movable contacts of the contact piece.

* * * * *